United States Patent [19]

Gamzo

[11] 4,438,919

[45] Mar. 27, 1984

[54] MECHANICAL BOUNCING, ROLLING AND SKATING APPARATUS

[76] Inventor: Israel Gamzo, 2570 - 35th Ave., Oakland, Calif. 94601

[21] Appl. No.: 359,786

[22] Filed: Mar. 19, 1982

[51] Int. Cl.[3] ..... A63B 25/00

[52] U.S. Cl. ..... 272/1 B; 272/114; 272/141; 272/145

[58] Field of Search ..... 272/65, 93, 110, 114, 272/134, 144, 141, 145; 280/1.175, 205, 218, 220, 226 R, 226 A; 297/307, 309, 312, 337, 338, 345, 347; 248/580, 599, 602

[56] References Cited

U.S. PATENT DOCUMENTS

| | | | |
|---|---|---|---|
| D. 223,675 | 5/1972 | Raphael | 272/114 X |
| 291,263 | 1/1884 | Ackley | 297/309 X |
| 1,509,750 | 9/1924 | Campbell | 272/134 |
| 1,527,451 | 2/1925 | Thalken | 272/114 X |
| 2,997,299 | 8/1961 | Wilkins, Jr. | 272/1 B |
| 2,999,688 | 9/1961 | Gabrielson | 272/144 X |
| 3,167,312 | 1/1965 | Blanchard | 272/114 X |
| 3,298,702 | 1/1967 | Rademacher | 280/1.22 |
| 3,306,626 | 2/1967 | Kawada | 280/205 |
| 3,427,019 | 2/1969 | Brown | 272/114 |
| 3,520,534 | 7/1970 | Bennett et al. | 272/114 |
| 3,627,314 | 12/1971 | Brown | 272/114 |
| 3,716,229 | 2/1973 | Van Der Cleyen et al. | 272/114 |
| 3,773,354 | 11/1973 | Morrison et al. | 280/218 |
| 4,081,182 | 3/1978 | O'Brien | 272/114 |

FOREIGN PATENT DOCUMENTS

| | | | |
|---|---|---|---|
| 2333472 | 7/1977 | France | 297/345 |

*Primary Examiner*—Richard T. Stouffer

*Attorney, Agent, or Firm*—Robert R. Tipton

[57] ABSTRACT

A recreational apparatus utilizes an upper housing having generally cylindrical side walls adapted to telescopically enclose a bottom support member utilizing a plurality of first guide members to engage corresponding second guide members connected to said upper housing. A support platform capable of supporting one or more persons is disposed about the outer periphery of the generally cylindrical side walls proximate the bottom edge thereof. A set of wheels are connected to the bottom support member to permit it to travel, roll and skate along a supporting surface. A gas filled balloon is inflated to fill the cavity within the bottom support member and act as a flotation device.

7 Claims, 8 Drawing Figures

MECHANICAL BOUNCING, ROLLING AND SKATING APPARATUS

BACKGROUND OF THE PRIOR ART

This invention relates generally to recreational apparatus and in particular to bouncing, rolling and skating recreational apparatus.

Some of the bouncing and trampoline type recreation apparatus of the prior art utilize a resilient ball having a circumferentially attached foot supporting platform thereabout and utilize a pair of foot clamps for the user's feet. The users thus jump up and down with the device clamped to their feet as a test of balance.

Other devices utilizing a pair of upper and lower telescoping pipes connected together by a spring and a pair of inflated resilient tori or donut shaped members which are arranged to bias the two telescoping pipes apart. A support handle extending through the top passenger supporting platform is grasped by the operator in the manner of a pogo stick.

Still other trampoline type bouncing devices utilize a passenger supporting platform biased away from a floor supporting platform by four or more resilient springs. Support handles and straps are provided for the users to hold the passenger supporting platform against their feet.

All of these devices are generally designed for only one user at a time and all of them require the operator to stand on the platform or object.

SUMMARY OF THE INVENTION

The apparatus of the present invention utilizes an upper housing having generally cylindrical side walls and top cover, with a support platform attached to the upper housing disposed about the outer periphery of the generally cylindrical side walls proximate the bottom edge thereof. A bottom support member adapted to be telescopically enclosed in the upper housing comprises a base support upon which are attached a plurality of first side members which extend upwardly terminating at their top at a top cover member. The plurality of guide members are adapted to engage an equal number of guide members attached to the inner periphery of the generally cylindrical side wall and slidably engage the corresponding guide members of said plurality of first side members attached to the base support. At least three or more wheels are attached to the base support to allow the recreational apparatus to roll or skate along a supporting surface.

It is, therefore, an object of the present invention to provide a recreational bouncing and rolling apparatus.

It is a further object of the present invention to provide a bounding and rolling apparatus in which the user can stand or sit on the upper housing.

It is yet another object of the present invention to provide a bouncing and rolling recreational apparatus in which the top housing telescopically encloses a bottom support member and is biased away from the bottom support member by resilient means.

It is a further object of the present invention to provide a bouncing and rolling recreational apparatus wherein a balloon is inflated with a gas and generally fills the space defined by the central portion of the bottom support member.

It is a further object of the present invention to provide a bouncing and rolling recreation apparatus having a domed cover and handle thereon in which a number of users can sit or stand and operate the device at the same time.

It is still a further object of the present invention to provide a bouncing, rolling and skating apparatus of a size for use by only one person in which foot retaining bindings are used to hold the apparatus to the operator's feet.

It is yet another object of the present invention to provide a bouncing and rolling recreation apparatus in which the bouncing motion can be damped by means of the structure of the apparatus.

These and other objects of the present invention will become manifest upon study of the following detailed description when taken together with the drawings.

DESCRIPTION OF THE PREFERRED EMBODIMENT

Figure 1:
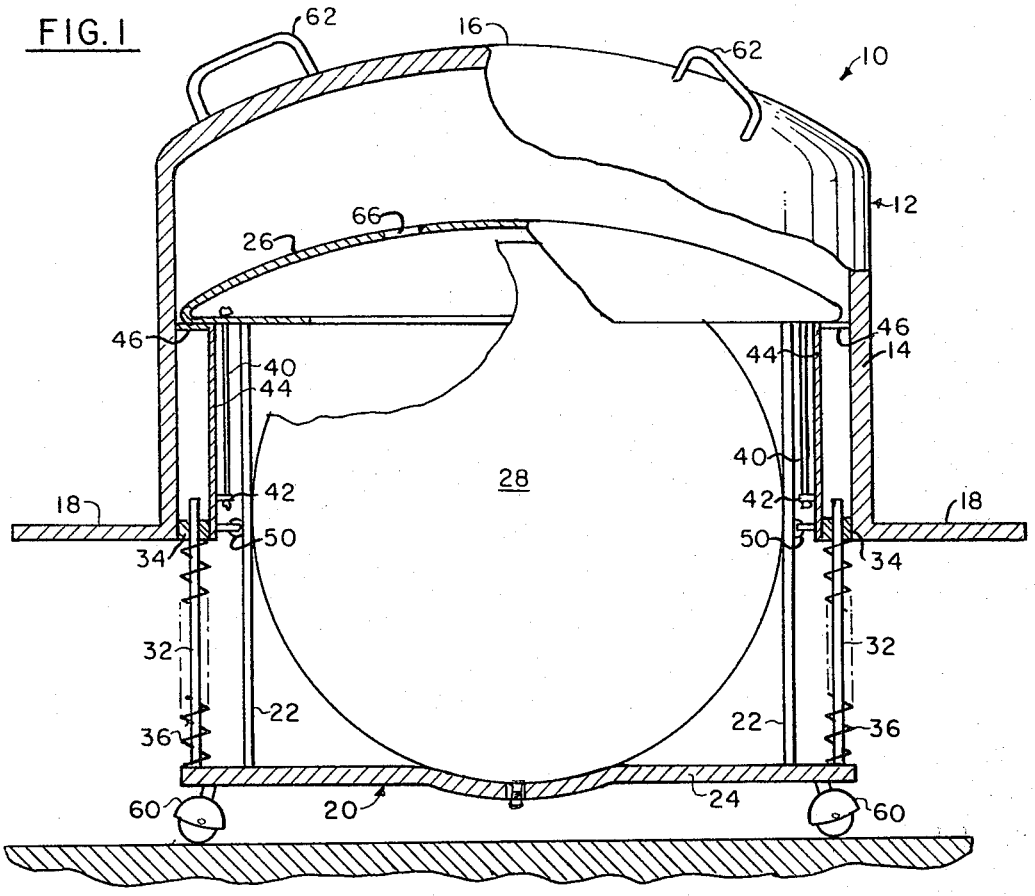
FIG. 1 is a partial elevational sectional view of the bouncing and rolling apparatus of the present invention showing the upper housing at its fully raised position.

With reference to FIG. 1 there is illustrated the assembled recreational bouncing, rolling and skating apparatus 10 of the present invention which comprises, basically, an upper housing 12 defining generally cylindrical side walls 14 and a top cover 16 defined by a dome attached proximate the top end of said upper housing 12 and with a support platform 18 attached to said upper housing 12 disposed about the outer periphery of said generally cylindrical side walls 14 proximate the bottom edge thereof.

Bouncing, rolling and skating recreational apparatus 10 of the present invention further comprises a bottom support member 20 comprising a plurality of first guide members 22 attached to a base support 24 and projecting upwardly therefrom, said guide members 22 adapted to telescopically receive said upper housing 12. A base support cover 26 is attached to said plurality of first guide members 22 proximate the top ends thereof.

A balloon 28 is inflated to fill the central cavity of said bottom support member 20 inside the area defined by the plurality of first guide members 22.

A guide-bias apparatus 30 is used between upper housing 12 and bottom support member 20 to bias upper housing 12 away from bottom support member 20 when there is no load or passenger on support platform 18. Guide-bias apparatus 30 comprises a plurality of spring guide rods 32 attached proximate the outer periphery of base support 24 extending upwardly therefrom to slidably engage guide rod support stop 34 attached proximate the bottom edge of cylindrical side wall 14 along the interior surface thereof. A helical spring 36 surrounds spring guide rods 32 having one end biased against support platform 22 and the other end biased against stop 34.

Figure 5:
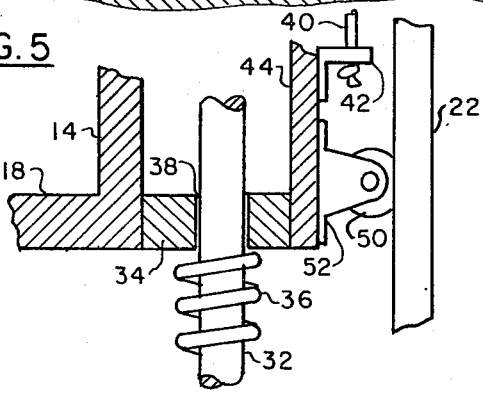
FIG. 5 is a cross-sectional elevational view of a detail illustrating the guide rod and roller configuration along with the spring biasing arrangement for the upper housing as it telescopically engages the bottom support member.

With reference to FIG. 5 there is illustrated the relationship of spring guide rod 32 to stop 34 in greater detail. It can be seen that spring guide rod 32 is adapted to slidably pass through hole 38 in stop 34.

With reference again to FIG. 1, additional resilient biasing of upper housing 12 away from bottom support member 20 is achieved using a plurality of resilient tension members 40, for example, bungee cords, having one end connected to bracket member 42, which is connected to stop 34 by bracket 44, while the other end of resilient tension member 40 is connected to base support cover 26.

A top stop 46 is attached to the inside wall of generally cylindrical side wall 14 proximate the midpoint between the bottom edge of generally cylindrical side wall 14 and top cover 16.

Guide rollers 50 attached to bracket 44 of upper housing 12 are adapted to engage guide members 22 to maintain a generally smooth upward and downward telescoping movement of upper housing 12.

It will be noted that base support cover 26 extends out to have a diameter slightly less than the inside diameter of generally cylindrical side wall 14. Thus they will engage top stop 46 to abate the biased upward movement of upper housing 12 relative to bottom support member 20.

Again with reference to FIG. 5, the arrangement of roller 50 relative to guide rod 22 is shown in greater detail. In FIG. 5, roller 50 is pivotally connected to roller support bracket 52 which is, in turn, attached to bracket 44 of upper housing 12. Bracket 44, in turn, is attached to spring stop 34.

Figure 6:
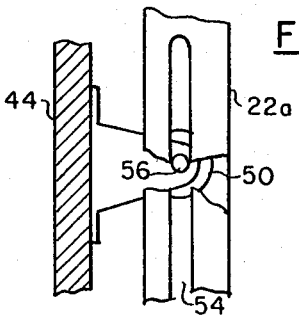
FIG. 6 is a cross-sectional elevation view of a detail illustration showing another method of construction of the guide rails and roller to guide the telescopic action of the upper housing relative to the bottom support member.

With reference to FIG. 6, another guide rod and roller configuration is illustrated in which a guide rod **22*a* comprises a U-shaped member having a slot in each leg thereof in which shaft 56 supporting guide roller 50 extends outwardly to engage slot 54. This configuration will prevent guide roller 50 from leaving the channel should the forces between guide roller 50 and guide member 22*a*** tend to pull them apart.

Figure 3:
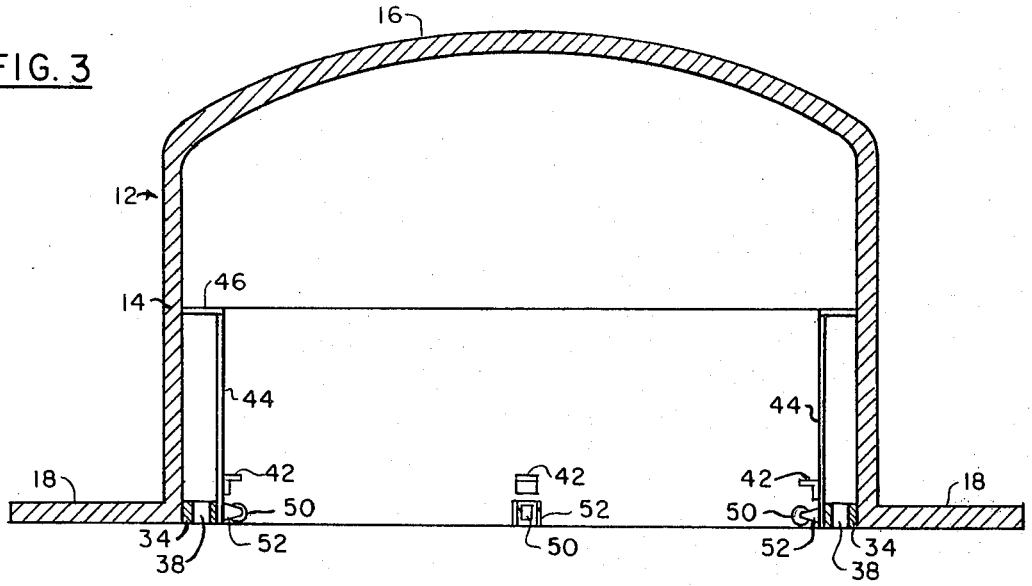
FIG. 3 is a cross-sectional elevational view of the upper housing of the bouncing and rolling recreational apparatus of the present invention showing the guide members and interior features in greater detail.
Figure 4:
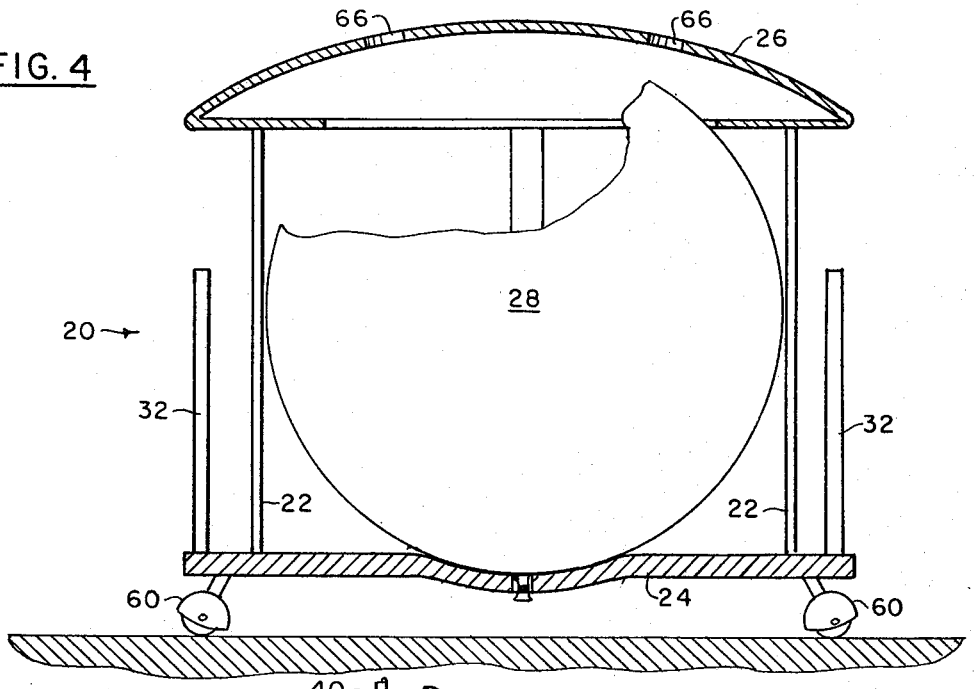
FIG. 4 is a cross-sectional elevational view of the bottom support member of the bouncing and rolling recreational apparatus of the present invention showing the inflated balloon occupying the central portion and the guide members and bottom support member cover in greater detail.

With reference to FIG. 3, there is illustrated a cross-sectional elevational view of upper housing 12 showing the disposition of brackets 42, guide roller 50 and guide roller support 52 along the inside of housing 12. Bracket 44 is shown as a continuous cylindrical member mounted inside of cylindrical side wall 14, however, it may just as easily be a separate box or bracket comprising a single spring biasing stop 34 for each spring guide rod 32.

It will be noted that at least three wheels or casters 60 are mounted on the underside of base support 24 so that the apparatus can be moved along a generally flat surface. In addition, although not shown in the drawing, casters or wheels 60 can be connected to base support 24 utilizing spring members to bias the casters away from base support 24 to add further resilience to the apparatus.

Casters or wheels 60 can all be able to swivel. This would make directional control of the apparatus difficult. Or, two of the wheels can be be arranged to not swivel thus permitting the apparatus to be steered using the wheels that swivel.

In addition, support handles 62, or straps 63 (FIG. 8), are provided in top cover 16 whereby several users standing on platform 18 can additionally support themselves while operating the device.

Operation:

To operate the bouncing, rolling and skating recreation apparatus 10 of the present invention, one or more users will stand on platform 18 (FIGS. 7 and 8) grasping handles 62, or straps 63 (FIG. 8), and jump up and down to cause upper housing 12 to to rise. As upper housing 12 rises, tension in helical springs 36 and resilient tension member 40 will be decreased. As upper housing 12 descends or falls telescoping over bottom support member 20, the compression in helical springs 36 and tension in resilient tension member 40 will increase and tend to push upper housing 12 away from bottom support member 20 when the downward pressure is removed.

Guide rollers 50, tracking along guide members 22, will maintain the motion of upper housing 12 vertically up and down as the users cause the apparatus to rise and fall.

Figure 2:
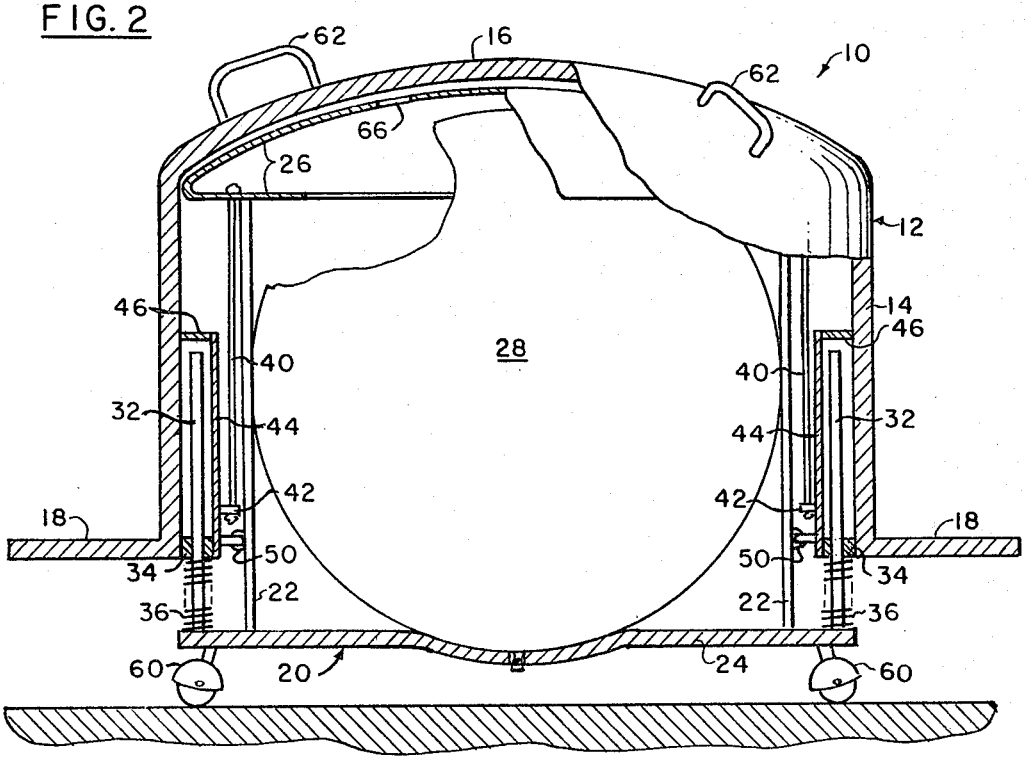
FIG. 2 is a partial elevational sectional view of the bouncing and rolling recreational apparatus of the present invention showing the upper housing at its lowest point of travel as it telescopically encloses the bottom support member.

With reference to FIG. 2, if sufficient downward pressure is applied to upper housing 12, it will be capable of sinking to its lowest point, as shown in FIG. 2, whereby the downward motion is checked by the full compression of helical springs 36 around spring guide rods 32.

Bottom travel can further be check by adjusting the length of spring guide rods 32 so that their tops will engage top stop 46, as shown in FIG. 2.

It can be seen from from FIG. 1, that, when upper housing 12 is in its uppermost position, there is a considerable gap between top cover 16 of upper housing 12 and base support cover 26. Allowing for a small clearance space between the outer peripheral edge of base support cover 26 and the inside surface of generally cylindrical side wall 14, the air entrapped in that space will be compressed and further act to create a resilient effect on upper housing 12 with a decreasing effect developing as the air leaks past the outer peripheral edge of base support cover 26. When upper housing 12 is at its lowest position, as shown in FIG. 2, all air will have been expelled from between the top of base support cover 26 and top cover 16. As upper housing 12 rises, a vacuum will then be created in the space between base support cover 26 and top cover 16. This will then cause a slowing down of the rate of rise of upper housing 12 as the air leaks past the space between the outer peripheral edge of base support cover 26 and then inside surface of cylindrical side wall 14.

The affects of this compression and rarefaction of air between base support cover 26 and top cover 16 can be reduced or controlled by the use of pressure relief ports or vent holes 66 penetrating base support cover 26. Thus the air trapped between base support cover 26 and top cover 16 can be release in a more controlled manner to regulate the dampening effect caused by the entrapment of air in the cavity.

Should the apparatus be used in water, balloon 28, being inflated with a gas, will act as a flotation unit thus permitting the apparatus to be used as a water recreation device.

Figure 7:
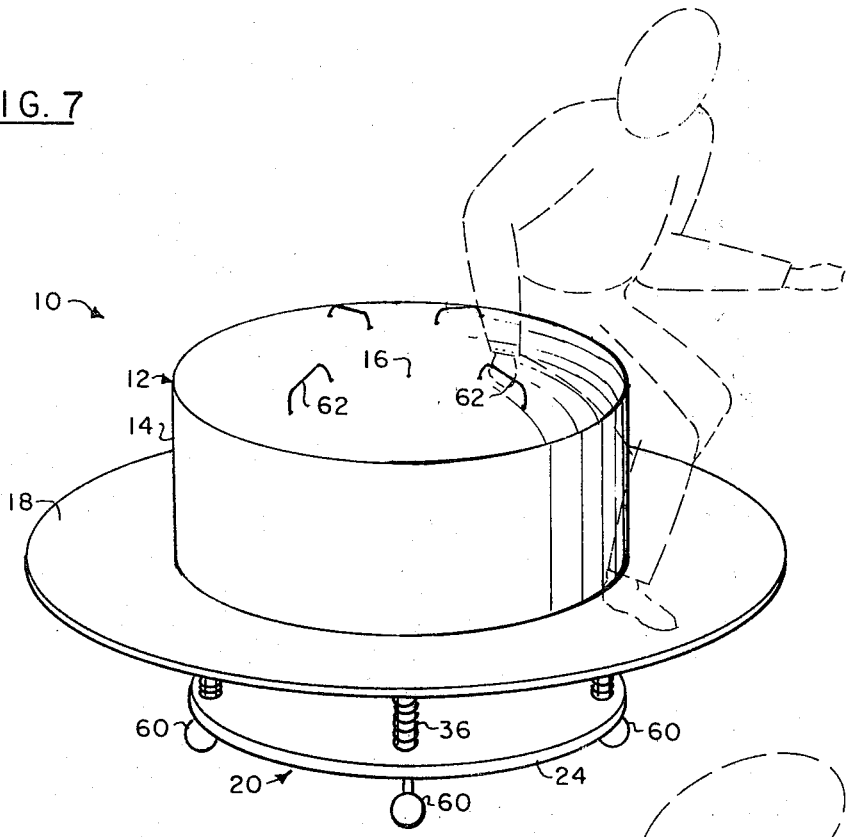
FIG. 7 is an isometric view of the larger version of the bouncing and rolling recreation apparatus of the present invention showing how the apparatus is used.

With reference to FIG. 7, there is illustrated an isometric view of the larger version of the bouncing, rolling and skating recreational apparatus 10 of the present invention showing the position of just one of a possible number of simultaneous users of the apparatus. It will be noted that the users can also sit on top of cover 16 of upper housing 12 in addition to using support platform 18 while grasping handles 62.

Figure 8:
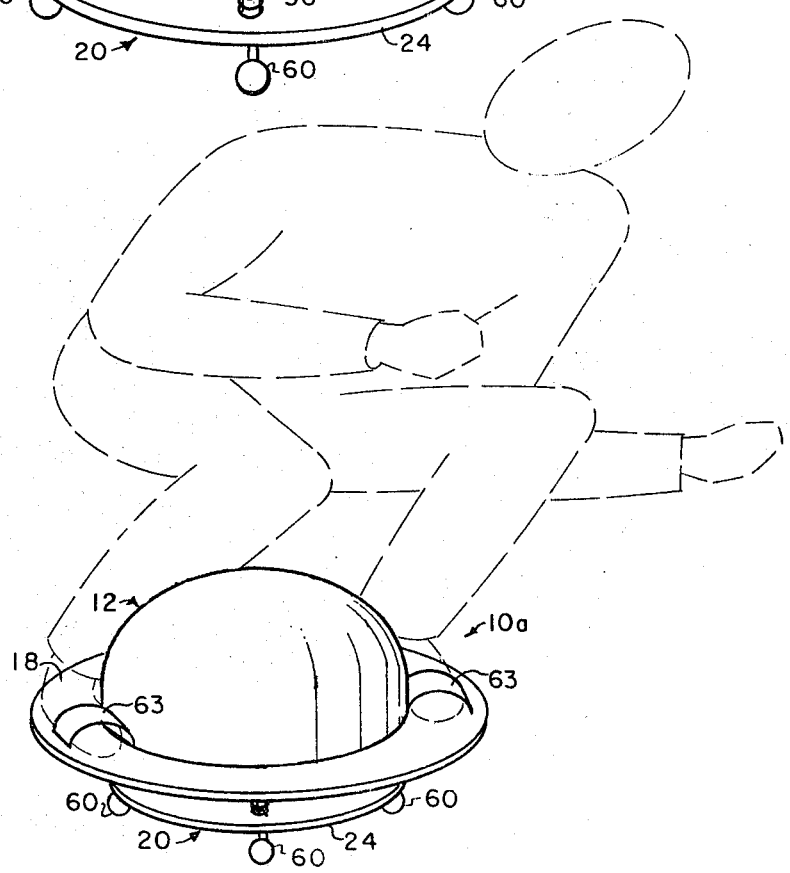
FIG. 8 is an isometric view of the smaller version of the bouncing and rolling recreation apparatus of the present invention showing how the apparatus is used.

With reference to FIG. 8, there is illustrated an isometric view of a smaller version of the bouncing, rolling and skating recreation apparatus 10*a* of the present invention showing a single user standing on support platform 18 straddling upper housing 12. A pair of a pair of foot retaining bindings or straps 63 attached to support platform 62 are used to permit the operator of the apparatus to keep the apparatus connected to his feet should the apparatus bounce or be lifted all the way clear of the supporting surface. Bindings 63 will also permit the operator to perform all kinds of strenuous twisting and jumping motions with the assurance that bouncing, rolling and skating apparatus 10*a* will follow such strenuous activities.

I claim:

1. A recreational apparatus comprising means defining an upper housing having generally cylindrical side walls and a top cover, a support platform attached to said upper housing disposed about the outer periphery of said generally cylindrical side wall proximate the bottom edge thereof, a bottom support member comprising a base support, a plurality of first guide members attached to said base support and extending upwardly therefrom, said guide members adapted to telescopically receive said upper housing, means defining a base support cover attached to said plurality of first guide members proximate the top ends thereof, and adapted to be enclosed within said cylindrical side walls of said upper housing, said base support cover comprising means for controlling the flow of air into and out of the space between said top cover of said upper housing and said base support cover, and means for resiliently biasing said upper housing away from said bottom support member.

2. The recreational apparatus as claimed in claim 1 wherein said upper housing further comprises a plurality of second guide members disposed about the inner periphery of said generally cylindrical side wall and adapted to slidably engage corresponding guide members of said plurality of first guide members attached to said base support.

3. The recreation apparatus as claimed in claim 1 wherein said bottom support member further comprises at least three wheels adapted to permit said bottom support member to roll along a supporting surface, and means for connecting said wheels proximate the underside of said base support of said bottom support member.

4. The recreational apparatus as claimed in claim 1 wherein said bottom support member further comprises means defining a balloon inflated with a gas and generally filling the space defined by said plurality of first guide members attached to said base support.

5. The recreational apparatus as claimed in claim 1 wherein said means for resiliently biasing said upper housing away from said bottom support member comprises a plurality of guide rods attached to said base support proximate the outer portion thereof, a first stop attached to the inside of said upper housing proximate the bottom of said generally cylindrical side wall, means defining a plurality of holes corresponding to said plurality of guide rods adapted to slidably receive said guide rods therethrough, a plurality of helical springs corresponding in number to said guide rods, each spring disposed about a guide rod and having one end biased against said bottom support and the other end biased against said first stop.

6. The recreational apparatus as claimed in claim 1 wherein said means for resiliently biasing said upper housing away from said bottom support member comprises a plurality of first bracket members disposed about the inside of said upper housing proximate the bottom of said generally cylindrical side wall, a plurality of resilient tension members corresponding in number to said plurality of first bracket members, each resilient tension member attached to each of said first bracket members and the other end attached to said base support proximate the top end thereof.

7. The recreation apparatus as claimed in claim 1 wherein said upper housing comprises a second stop member connected to the inner surface of said generally cylindrical surface of said side wall at a point between said bottom edge of said cylindrical side wall and said top cover and adapted to engage said base support cover whereby the upward travel of said upper housing is stopped.

* * * * *